US010001734B2

(12) United States Patent
Seo et al.

(10) Patent No.: US 10,001,734 B2
(45) Date of Patent: Jun. 19, 2018

(54) FIXING DEVICE AND IMAGE FORMING APPARATUS INCLUDING FIXING DEVICE WITH VIBRATION DAMPENING

(71) Applicants: Hiroshi Seo, Kanagawa (JP); Yuusuke Furuichi, Kanagawa (JP); Takashi Fujita, Kanagawa (JP); Daisuke Inoue, Tokyo (JP); Takamasa Hase, Tokyo (JP)

(72) Inventors: Hiroshi Seo, Kanagawa (JP); Yuusuke Furuichi, Kanagawa (JP); Takashi Fujita, Kanagawa (JP); Daisuke Inoue, Tokyo (JP); Takamasa Hase, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/377,927

(22) Filed: Dec. 13, 2016

(65) Prior Publication Data

US 2017/0185019 A1 Jun. 29, 2017

(30) Foreign Application Priority Data

| | | |
|---|---|---|
| Dec. 25, 2015 | (JP) | 2015-255189 |
| Apr. 8, 2016 | (JP) | 2016-078063 |
| Jul. 25, 2016 | (JP) | 2016-145187 |
| Oct. 26, 2016 | (JP) | 2016-209381 |

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 8,965,261 | B2 * | 2/2015 | Matsuura | G03G 15/2053 399/329 |
| 2013/0209120 | A1 | 8/2013 | Namekata et al. | |
| 2013/0209122 | A1 | 8/2013 | Yamashina et al. | |
| 2013/0209123 | A1 | 8/2013 | Waida et al. | |
| 2013/0209124 | A1 | 8/2013 | Saito et al. | |

(Continued)

FOREIGN PATENT DOCUMENTS

| | | |
|---|---|---|
| JP | 2008-040420 | 2/2008 |
| JP | 2011-033653 | 2/2011 |

(Continued)

OTHER PUBLICATIONS

U.S. Appl. No. 15/182,034, filed Jun. 14, 2016.

*Primary Examiner* — William J Royer
(74) *Attorney, Agent, or Firm* — Duft Bornsen & Fettig LLP

(57) ABSTRACT

A fixing device includes an endless, rotatable fixing belt, a pressure rotator, a nip formation pad, a support, and a vibration repressor. The pressure rotator presses an outer surface of the fixing belt. The nip formation pad is disposed at an inner side of the fixing belt, to abut on the pressure rotator with the fixing belt interposed between the nip formation pad and the pressure rotator to form a fixing nip. The support is disposed at the inner side of the fixing belt, to support the nip formation pad. The vibration repressor is disposed between the nip formation pad and the support, to repress vibration of the nip formation pad.

17 Claims, 12 Drawing Sheets

(56) References Cited

U.S. PATENT DOCUMENTS

| | | | |
|---|---|---|---|
| 2013/0209126 | A1 | 8/2013 | Seo et al. |
| 2013/0209127 | A1 | 8/2013 | Fujimoto et al. |
| 2013/0209128 | A1 | 8/2013 | Saito et al. |
| 2013/0308990 | A1 | 11/2013 | Samei et al. |

FOREIGN PATENT DOCUMENTS

| | | |
|---|---|---|
| JP | 2012-198516 | 10/2012 |
| JP | 2014-146063 | 8/2014 |
| JP | 2015-055709 | 3/2015 |

* cited by examiner

FIXING DEVICE AND IMAGE FORMING APPARATUS INCLUDING FIXING DEVICE WITH VIBRATION DAMPENING

CROSS-REFERENCE TO RELATED APPLICATIONS

This patent application is based on and claims priority pursuant to 35 U.S.C. § 119(a) to Japanese Patent Application Nos. 2015-255189, filed on Dec. 25, 2015, 2016-078063, filed on Apr. 8, 2016, 2016-145187, filed on Jul. 25, 2016, and 2016-209381, filed on Oct. 26, 2016, in the Japan Patent Office, the entire disclosure of which is hereby incorporated by reference herein.

BACKGROUND

Technical Field

Embodiments of the present disclosure relate to a fixing device and an image forming apparatus including the fixing device.

Related Art

A fixing device is known that includes an endless fixing belt and a pressure rotator pressing an outer surface of the fixing belt and heats the fixing belt using a heat source. For example, in a fixing device, a nip formation pad disposed at an inner side of an endless-shaped, rotatable fixing belt abuts on a pressure roller via the fixing belt to form a fixing nip between the fixing belt and the pressure roller. At the inner side of the fixing belt, the nip formation pad is supported by, e.g., a stay as a support.

SUMMARY

In an aspect of the present disclosure, there is provided a fixing device that includes an endless, rotatable fixing belt, a pressure rotator, a nip formation pad, a support, and a vibration repressor. The pressure rotator presses an outer surface of the fixing belt. The nip formation pad is disposed at an inner side of the fixing belt, to abut on the pressure rotator with the fixing belt interposed between the nip formation pad and the pressure rotator to form a fixing nip. The support is disposed at the inner side of the fixing belt, to support the nip formation pad. The vibration repressor is disposed between the nip formation pad and the support, to repress vibration of the nip formation pad.

In another aspect of the present disclosure, there is provided a fixing device that includes an endless, rotatable fixing belt, a pressure rotator, a nip formation pad, a support, and a stopper. The pressure rotator presses an outer surface of the fixing belt. The nip formation pad is disposed at an inner side of the fixing belt, to abut on the pressure rotator with the fixing belt interposed between the nip formation pad and the pressure rotator to form a fixing nip. The support is disposed at the inner side of the fixing belt, to support the nip formation pad. The stopper holds the nip formation pad and the support.

In still another aspect of the present disclosure, there is provided a fixing device that includes an endless, rotatable fixing belt, a pressure rotator, a nip formation pad, a support, and a positioning unit. The pressure rotator presses an outer surface of the fixing belt. The nip formation pad is disposed at an inner side of the fixing belt, to abut on the pressure rotator with the fixing belt interposed between the nip formation pad and the pressure rotator to form a fixing nip. The support is disposed at the inner side of the fixing belt, to support the nip formation pad. The positioning unit positions the nip formation pad relative to the support in a rotation direction of the fixing belt in the fixing nip.

In still yet another aspect of the present disclosure, there is provided an image forming apparatus that includes an image forming device to form an image on a recording medium and the fixing device according to any one of the above-described aspects to fix the image on the recording medium.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
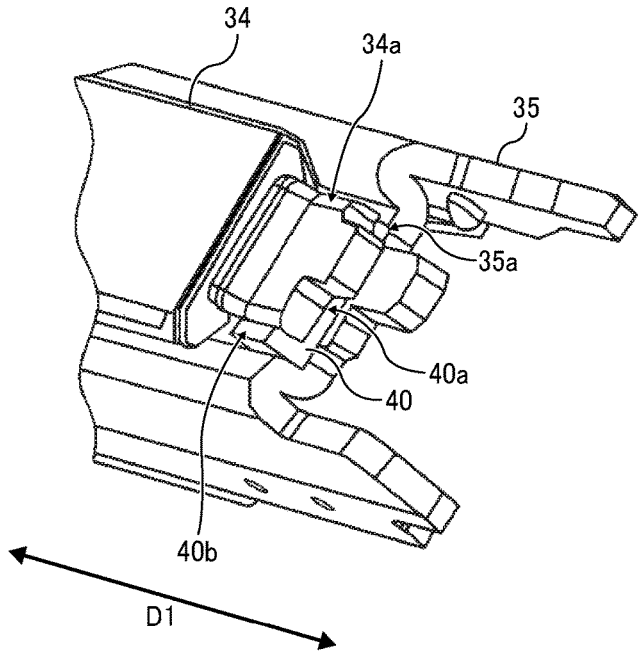
FIG. 1 is a perspective view of a state in which a vibration repressor is disposed between a nip formation pad and a stay in a fixing device according to a first configuration example.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First Embodiment

Figure 2:
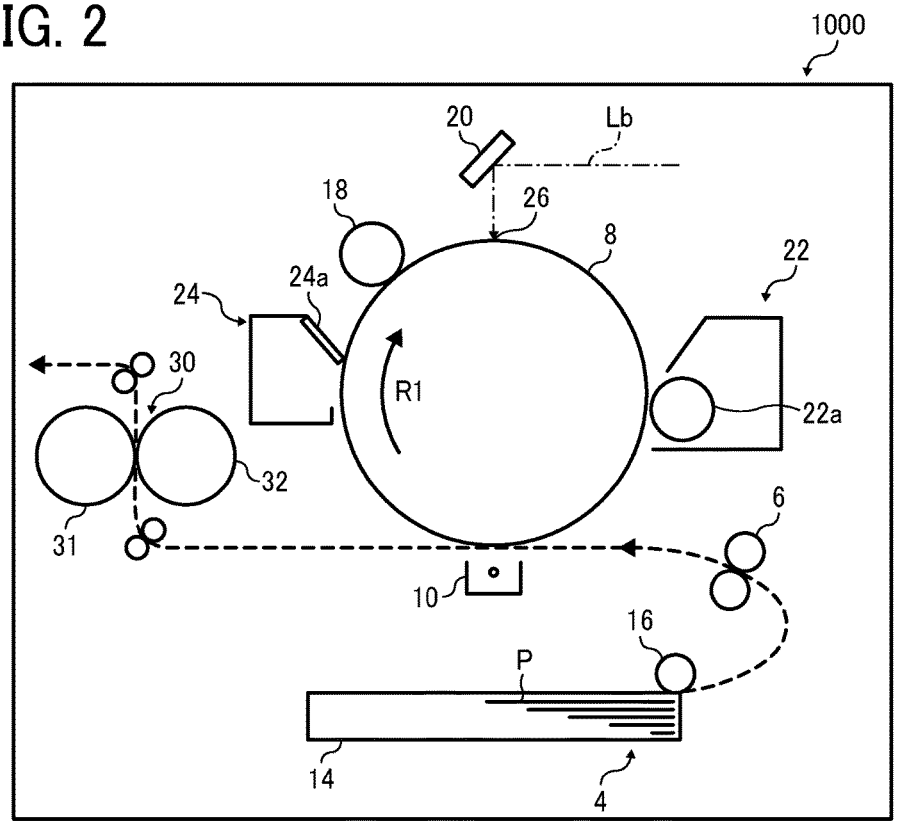
FIG. 2 is a schematic view of a configuration of an image forming apparatus according to an embodiment of the present disclosure.

FIG. 2 is a schematic view of a configuration of an image forming apparatus according to an embodiment of the present disclosure. As illustrated in FIG. 2, an image forming apparatus 1000 according to the present embodiment includes, e.g., a sheet feeding device 4, paired registration rollers 6, a photoconductor drum 8 serving as an image bearer, a transfer device 10, and a fixing device 30. In the present embodiment, the image forming apparatus 1000 is illustrated as a printer in FIG. 2. However, the image forming apparatus according to an embodiment of the present embodiment is not limited to the printer.

The sheet feeding device 4 includes a sheet feeding tray 14 in which a sheet of paper P serving as a recording material is housed in a stacked state and a sheet feed roller 16 which sends the sheet P housed in the sheet feeding tray 14 one by one in a separate manner sequentially from the uppermost sheet. The sheet P sent by the sheet feed roller 16 is temporarily stopped by the paired registration rollers 6, and a postural deviation of the sheet P is corrected. Then, the sheet P is sent to a transfer portion by the paired registration rollers 6 at a timing in synchronization with rotation of the photoconductor drum 8, that is, a timing at which a leading end of a toner image formed on the photoconductor drum 8 and a predetermined position of a leading end of the sheet P in a conveyance direction of the sheet P indicated by arrow D2 in FIG. 3 match each other.

A charging roller 18, a mirror 20 forming an exposure unit, a developing device 22 including a developing roller 22*a*, the transfer device 10, a cleaning device 24 including a cleaning blade 24*a*, and the like are disposed in the recited order around the photoconductor drum 8 in a rotation direction of the photoconductor drum 8 indicated by arrow R1 in FIG. 2. An exposed portion 26 of the photoconductor drum 8 is irradiated with exposure light Lb between the charging roller 18 and the developing device 22 via the mirror 20, and the exposure light Lb is scanned.

An image forming operation of the image forming apparatus 1000 is performed as follows. That is, when the rotation of the photoconductor drum 8 is started, the surface of the photoconductor drum 8 is evenly charged by the charging roller 18, the exposed portion 26 is irradiated with the exposure light Lb based on image data, and the exposure light Lb is scanned to form a latent image corresponding to an image to be formed. The latent image is moved to a position opposing the developing device 22 with the rotation of the photoconductor drum 8, and toner is fed to the latent image by the developing device 22 and made visible, thereby forming a toner image. The toner image formed on the photoconductor drum 8 is transferred onto the sheet P, which enters the transfer portion at a predetermined timing, by application of a transfer bias from the transfer device 10. The sheet P, on which the toner image has been transferred, is conveyed toward the fixing device 30, and the toner image is fixed to the sheet P by the fixing device 30, and then the sheet P is ejected to and stacked on a sheet ejection tray.

A residual toner, which remains on the photoconductor drum 8 without being transferred to the sheet P from the photoconductor drum 8 at the transfer portion reaches the cleaning device 24 along with the rotation of the photoconductor drum 8 and is scraped off by the cleaning blade 24*a*, and the surface of the photoconductor drum 8 is cleaned. Then, a residual potential on the photoconductor drum 8 is removed by a charge removing device, and a subsequent image formation step is prepared.

Here, an electrophotographic image forming apparatus outputs a copied image through the following steps as it has been known. That is, an electrostatic latent image formed on the photoconductor drum 8 serving as the latent image bearer is processed to be made visible using the toner, and the toner image is transferred onto the recording material such as the sheet and fixed, and the copied image is output. Examples of a fixing system used in the image forming apparatus include a heating-roller fixing system, a belt fixing system, a film fixing system, an electromagnetic induction heating fixing system, and the like.

A fixing roller and a pressure roller, which oppose and abut on each other with a conveyance path of the sheet interposed between the fixing roller and the pressure roller, are used in the heat-fixing-roller fixing system. In the system, the toner image melts and permeates into the sheet by action between heat from a heat source, which is disposed in the fixing roller, and pressure corresponding to a pressing force from the pressure roller. The same phenomenon that the toner image melts and permeates into the sheet also occurs in a fixing system having the following configuration. A fixing belt, which serves as a good heat conductor instead of the fixing roller, the pressure roller, a roller around which the belt is wound, and a heat source for the belt are used in the belt fixing system. A fixing belt, which serves as a good heat conductor instead of the fixing roller, the pressure roller, a roller around which the belt is wound, and a heat source for the belt are used in the film fixing system. A configuration in which an electromagnetic induction coil enhancing heat generation efficiency is disposed in a heater is used in the electromagnetic induction heating fixing system.

The fixing system has the following request. The request is to shorten a warm-up time, and further, to shorten a first print time. Incidentally, the warm-up time is the time that is required until a predetermined temperature (reload temperature) enabling print from a room temperature state such as activation of power. In addition, the first print time is the time required until performing of printing preparation and a printing operation and completing ejection after reception of a printing request. There is a case in which a fixing failure occurs in the fixing device due to the following reasons. The image forming apparatus is the apparatus capable of performing high-speed processing. When the number of fixed sheets per unit time, that is, the number of passing sheets, which pass through the fixing device, increases by the high-speed processing, it is also necessary to increase the amount of heat fed to the sheet moving at high speed. In such a manner, the amount of heat required for fixing is applied to the sheet in accordance with the shortening in time which takes for the sheet to pass through the fixing device.

However, a decrease in temperature becomes great unless it is possible to secure the amount of heat required at the beginning of continuous printing, and there is a risk that the fixing failure occurs if the sheet passes without securing the amount of heat required at the time of the continuous printing which is performed at high speed. In addition, there is a case in which a so-called temperature drop where the amount of heat is insufficient becomes a disadvantage in particular at the beginning of the continuous printing since the number of passing sheets per unit time increases and the amount of required heat increases along with the increase in speed of the image forming apparatus, and there is a disadvantage that causes the fixing failure occurring in the case of increasing the speed.

Meanwhile, there is a fixing system which is called a surf fixing system employing a ceramic heater in addition to the fixing system exemplified above. The surf fixing system employs a configuration in which only a nip is locally heated, and other portions are not heated. In the fixing system, it is possible to reduce heat capacity and size as compared to the fixing device of the belt system, and thus, it is possible to obtain the rise to a predetermined temperature and the shortening of the first print time, but there is the following disadvantage. That is, the surf fixing system does not heat the portions other than the locally heated nip, and thus, a fixing belt is in the state of being cooled the most in an inlet of the sheet of the nip, and there is a disadvantage that the fixing failure is likely to occur. In particular, the fixing belt rotates fast in the high-speed machine, and the radiation of the belt at the portions other than the nip increases, and thus, there is a disadvantage that the fixing failure is more likely to occur.

Figure 3:
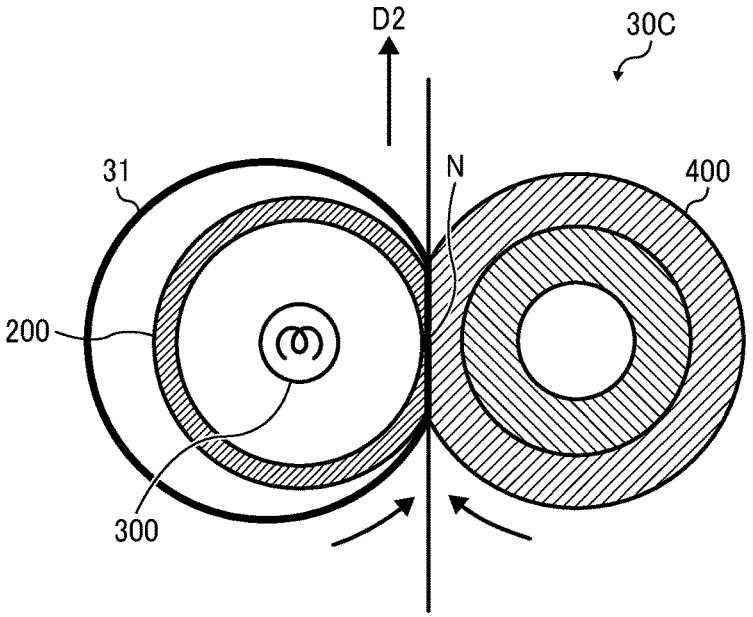
FIG. 3 is a diagram of a comparative example of a fixing device that indirectly heats a fixing belt via a metal heat conductor.

Thus, a fixing device, which is capable of obtaining a favorable fixing performance even when being mounted to a highly productive image forming apparatus, has, for example, a configuration of employing a fixing belt in order to deal with the above disadvantages. FIG. 3 is a schematic view of a fixing device 30C according to a comparative example having such a configuration. The fixing device 30C includes a fixing belt 31, a pipe-shaped metal heat conductor 200 disposed inside the fixing belt 31, a heat source 300 disposed inside the metal heat conductor 200, and a pressure roller 400 which abuts on the metal heat conductor 200 with the fixing belt 31 interposed between the pressure roller 400 and the metal heat conductor 200 to form a fixing nip N. The fixing belt 31 is rotated by rotation of the pressure roller 400, and at this time, the metal heat conductor 200 guides movement of the fixing belt 31. In addition, it is possible to warm the entire fixing belt 31 as the fixing belt 31 is heated by the heat source 300 inside the metal heat conductor 200 with the metal heat conductor 200 interposed between the fixing belt 31 and the heat source 300. Accordingly, it is possible to shorten the first print time from a heating standby state, and to resolve the shortage of the amount of heat at the time of high-speed rotation.

However, there is room to further improve the thermal efficiency in order to further save energy and improve the first print time. Thus, a configuration, which directly heats a fixing belt instead of indirectly heating the fixing belt via an interposed metal heat conductor (the metal heat conductor 200 in FIG. 3), is employed. Such a configuration can reduce power consumption and further shorten the first print time from the heating standby state. In addition, cost down can be expected as the metal heat conductor is not disposed.

Figure 4:
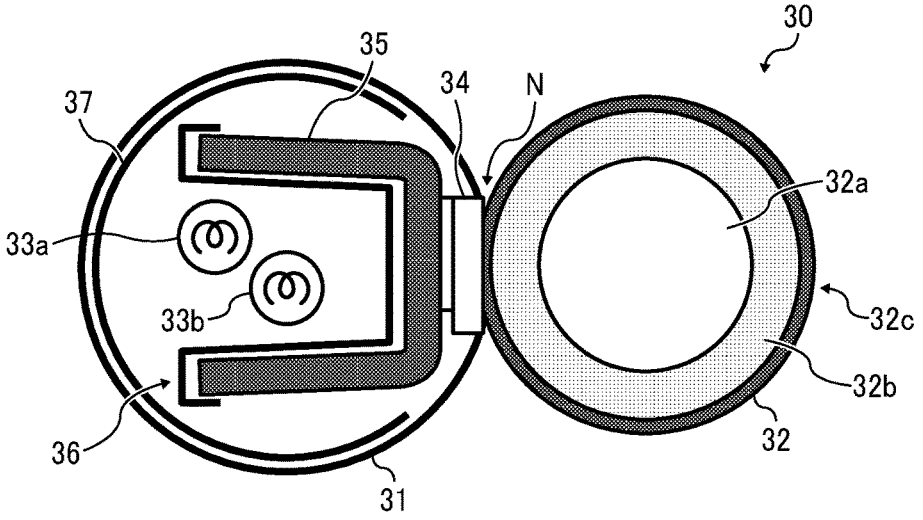
FIG. 4 is a schematic view of an example of a fixing device according to an embodiment of the present disclosure.

FIG. 4 is a schematic view of an example of the fixing device 30 according to the present embodiment. The fixing device 30 includes the fixing belt 31 and a pressure roller 32. The fixing belt 31 is an endless moving member with a hollow inside and serves as a fixing rotator. The pressure roller 32 serves as a pressure rotator being an opposed rotator rotatably disposed to oppose the fixing belt 31. Halogen heaters 33*a* and 33*b*, which serve as heat sources to heat the fixing belt 31, and a nip formation pad 34 which forms the fixing nip N with the pressure roller 32, opposed with the fixing belt 31 interposed between the nip formation pad 34 and the pressure roller 32, at the inner side of the fixing belt 31. Further, a stay 35, which serves as a support to support the nip formation pad 34, and a reflector 36, which reflects light radiating from the halogen heaters 33*a* and 33*b* toward the fixing belt 31, are disposed at the inner side of the fixing belt 31.

In addition, a flange 37, which serves as a holder to hold the fixing belt 31, is inserted into each of the opposed ends in a width direction of the fixing belt 31 indicated by arrow D1 in FIG. 1, and the fixing belt 31 is rotatably held while being guided by the flange 37. In addition, the halogen heaters 33*a* and 33*b*, the stay 35, the flange 37 and the like are secured by a pair of side plates in the width direction D1 of the fixing belt 31 of the fixing device 30.

The fixing belt 31 is made using an endless belt member (also including a film) which is thin and has flexibility. The fixing belt 31 includes a base member at an inner circumferential side which is formed using a metal material such as nickel or stainless steel or a resin material such as polyimide (PI). In addition, the fixing belt 31 includes a release layer at an outer circumferential side which is formed using tetrafluoroethylene-perfluoro(alkyl vinyl ether) copolymer (PFA), polytetrafluoroethylene (PTFE) or the like. In addition, an elastic layer, which is formed using a rubber material such as a silicone rubber, a foamed silicone rubber, and a fluororubber may be interposed between the base member and the release layer.

The pressure roller 32 includes a cored bar 32*a*, an elastic layer 32*b*, and a release layer 32*c*. Incidentally, the elastic layer 32*b* is disposed on the surface of the cored bar 32*a* and is made of a foamed silicone rubber, a silicone rubber, a fluororubber, or the like. In addition, the release layer 32*c* is disposed on the surface of the elastic layer 32*b* and is made of PFA, PTFE, or the like. The pressure roller 32 is pressed by a pressing member such as a spring toward the fixing belt 31, and accordingly, abuts on the nip formation pad 34 with the fixing belt 31 interposed between the pressure roller 32 and the nip formation pad 34. The fixing nip N having a predetermined width is formed as the elastic layer 32*b* of the pressure roller 32 is compressed at a point at which the pressure roller 32 and the fixing belt 31 press against each other. The pressure roller 32 is rotatably driven by a drive force from a drive source such as a motor disposed in an apparatus body of the image forming apparatus 1000. When the pressure roller 32 is rotatably driven, the drive force of the pressure roller 32 is transmitted to the fixing belt 31 at the fixing nip N, and the fixing belt 31 is driven to rotate.

The pressure roller 32 is a solid roller in the present embodiment, but may be a hollow roller. In such a case, a heat source such as a halogen heater may be disposed inside the pressure roller 32. In addition, the heat capacity is reduced, and the fixing performance is improved when the elastic layer is not disposed. However, there is a possibility that minute unevenness of the belt surface is transferred to an image and uneven gloss is generated at a solid portion of the image when the unfixed toner is compressed and fixed. In order to prevent such uneven gloss, it is desirable to provide the elastic layer having a thickness of 100 μm or more. It is possible to absorb the minute unevenness by the elastic deformation of the elastic layer by providing the elastic layer having the thickness of 100 μm or more, and thus, it is possible to avoid the generation of uneven gloss. The elastic layer 32*b* may be a solid rubber or may be made of a sponge rubber when there is no heat source inside the pressure roller 32. The sponge rubber is more desirable because heat insulating properties are enhanced, and the heat of the fixing belt 31 is hardly deprived. In addition, the fixing rotator and the opposed rotator are not limited to the case of pressing against each other, but can be simply in contact with each other without performing the pressing.

The halogen heaters 33*a* and 33*b* generate heat by being output-controlled by a power source disposed in the apparatus body of the image forming apparatus 1000. The output control is performed based on a detection result of surface temperature of the fixing belt 31 obtained by a temperature detection sensor. It is possible to maintain the temperature (fixing temperature) of the fixing belt 31 to a desired temperature through such output control of the halogen heaters 33*a* and 33*b*. In addition, electromagnetic induction heating (IH), a resistance heat generator, a carbon heater, or the like may be used other than the halogen heater as the heat source to heat the fixing belt 31, or a system in which the fixing belt 31 is heated by the resistance heat generator disposed in the nip formation pad 34, for example, may be disposed.

Figure 5:
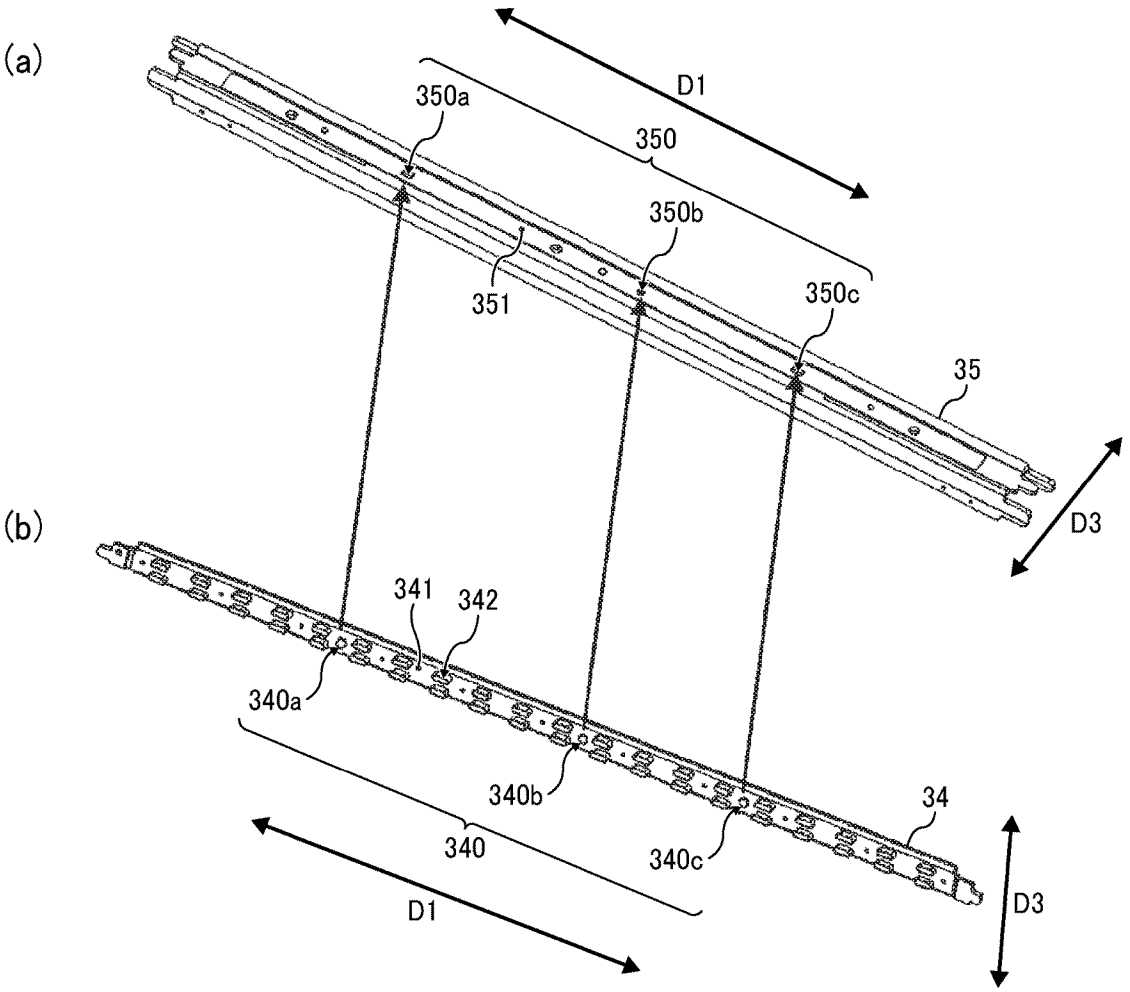
FIG. 5 is a perspective view of (a) the stay viewed from a support face that supports the nip formation pad and (b) the nip formation pad viewed from an opposed face that opposes the support face of the stay.

The nip formation pad 34 is a member that receives the pressing force of the pressure roller 32 and defines a shape of the fixing nip N. Thus, the nip formation pad 34 is disposed in parallel to the width direction D1 of the fixing belt 31 or an axial direction of the pressure roller 32, and is supported by the stay 35 which is used as the support of the nip formation pad 34. FIG. 5 includes (a) a perspective view of the stay 35 viewed from a support face 351 that supports the nip formation pad 34 and (b) a perspective view of the nip formation pad 34 viewed from an opposed face 341 that opposes the support face 351 of the stay 35. As illustrated in (a) of FIG. 5, three through-holes 350*a*, 350*b* and 350*c* are disposed in the width direction D1 of the fixing belt 31 on the support face 351 of the stay 35 which supports the nip formation pad 34. In addition, three cylindrical bosses 340*a*, 340*b* and 340*c* are disposed on the opposed face 341 of the nip formation pad 34, which opposes the support face 351 of the stay 35, so as to correspond to the through-holes 350*a*, 350*b* and 350*c* of the stay 35 as illustrated in (b) of FIG. 5. In addition, a plurality of supported portions 342, which abut on and support the support face 351 of the stay 35, are disposed in two rows in a slide rotation direction of the fixing belt 31 indicated by arrow D3 in FIG. 5 and side by side in the width direction D1 of the fixing belt 31 on the opposed face 341 of the nip formation pad 34. Further, the bosses 340*a*, 340*b* and 340*c* of the nip formation pad 34 are engaged with the through-holes 350*a*, 350*b* and 350*c* of the stay 35, and each of the plurality of supported portions 342 of the nip formation pad 34 is caused to abut on the support face 351 of the stay 35 at the time of assembly. In such a manner, the generation of deformation in the nip formation pad 34 due to the pressure of the pressure roller 32 is repressed by supporting the nip formation pad 34 using the stay 35, and an even nip width is obtained in parallel in the axial direction of the pressure roller 32.

Incidentally, the through-holes 350*a* and 350*c* are long holes which are elongated in the width direction D1 of the fixing belt 31, the through-hole 350*b* is a substantially circular hole, and each width in the short-side direction, which is the same direction as the slide rotation direction D3 of the fixing belt 31, of the through-holes 350*a* and 350*c*, and a diameter of the through-hole 350*b* have the same dimension. Each diameter of the bosses 340*a*, 340*b* and 340*c* is substantially the same as the diameter of the through-hole 350*b*, and a margin is disposed in the slide rotation direction D3 of the fixing belt 31 between each boss 340 and each through-hole 350 fit to each other.

Although it is desirable to form the stay 35 using a metal material having high mechanical strength such as stainless steel and iron in order to satisfy a function of preventing deformation of the nip formation pad 34, the stay 35 may be also made of resin. In addition, the shape of the fixing nip N is flat in the present embodiment, but may be a recessed shape or another shape. When the shape of the fixing nip N is the recessed shape, the ejection direction of the leading end of the sheet P is deviated to the pressure roller 32, and the separability is improved, and thus, the generation of paper jam is repressed.

The reflector 36 is made of aluminum, stainless steel, or the like whose surface can be used as a reflecting face and is disposed between the stay 35 and the halogen heaters 33*a* and 33*b*. It is desirable to form the reflector 36 using a metal material having a high melting point or the like since the reflector 36 is directly heated by the halogen heaters 33*a* and 33*b*. The light radiated from the halogen heaters 33*a* and 33*b* toward the stay 35 is reflected toward the fixing belt 31 by arranging the reflector 36 between the stay 35 and the halogen heaters 33*a* and 33*b*. Accordingly, it is possible to increase the amount of light to be emitted to the fixing belt 31 and to efficiently heat the fixing belt 31. In addition, it is possible to repress transmission of the radiation heat from the halogen heaters 33*a* and 33*b* to the stay 35 and the like and to obtain the energy saving. Incidentally, a face of the stay 35 on the halogen heaters 33*a* and 33*b* may be subjected to adiabatic treatment or mirror treatment such as polishing and painting to form the reflecting face without providing the reflector 36 as in the present embodiment. However, it is difficult to freely select the shape and material of the stay 35 in order to secure the strength of the stay 35. Thus, it is possible to make the reflector 36 and the stay 35 specialized in the respective functions as the degree of freedom in selection of the shape and material increases when the reflector 36 is separately provided from the stay 35 as in the present embodiment. In addition, a position of the reflector 36 is close to the halogen heaters 33*a* and 33*b* when the reflector 36 is disposed between the halogen heaters 33*a* and 33*b* and the stay 35, and thus, it is possible to efficiently heat the fixing belt 31.

Stick-slip may be generated between the nip formation pad 34 and the fixing belt 31 which are secured in the fixing device 30 of the system in which the fixing nip N is formed with the nip formation pad 34 and the fixing belt 31 is slidably conveyed. Further, there is a case in which the stick-slip becomes a vibration generating source, and vibration noise generates using a structural body as a transmission system and the fixing belt 31 as an amplifier. Such vibration noise is also caused depending on a natural frequency defined by a material shape of the nip formation pad 34, and is generally generated with a frequency of about 100 Hz to 300 Hz in many cases. There is a method of setting a set speed of the fixing belt 31 as fast as possible with respect to such vibration noise. The method is based on an experienced fact that the stick-slip caused by the slide is easily generated at high-temperature and low-speed state, and the stick-slip is hardly generated when the temperature is low or the speed is fast. In particular, it has been well-known that it is advantageous to increase the speed of the rotational speed at the time of launch or cooling rotation after sheet passage, for example, by detecting the surface temperature of the belt when the belt and the nip formation pad 34 inside the fixing device 30 become high temperature. However, the change of the rotational speed of the fixing device 30 greatly affects the service life. The fixing device 30 reaches a predetermined service-life traveling time early as the rotation time at high speed increases, which is not preferable from a viewpoint of economic efficiency.

Figure 6:
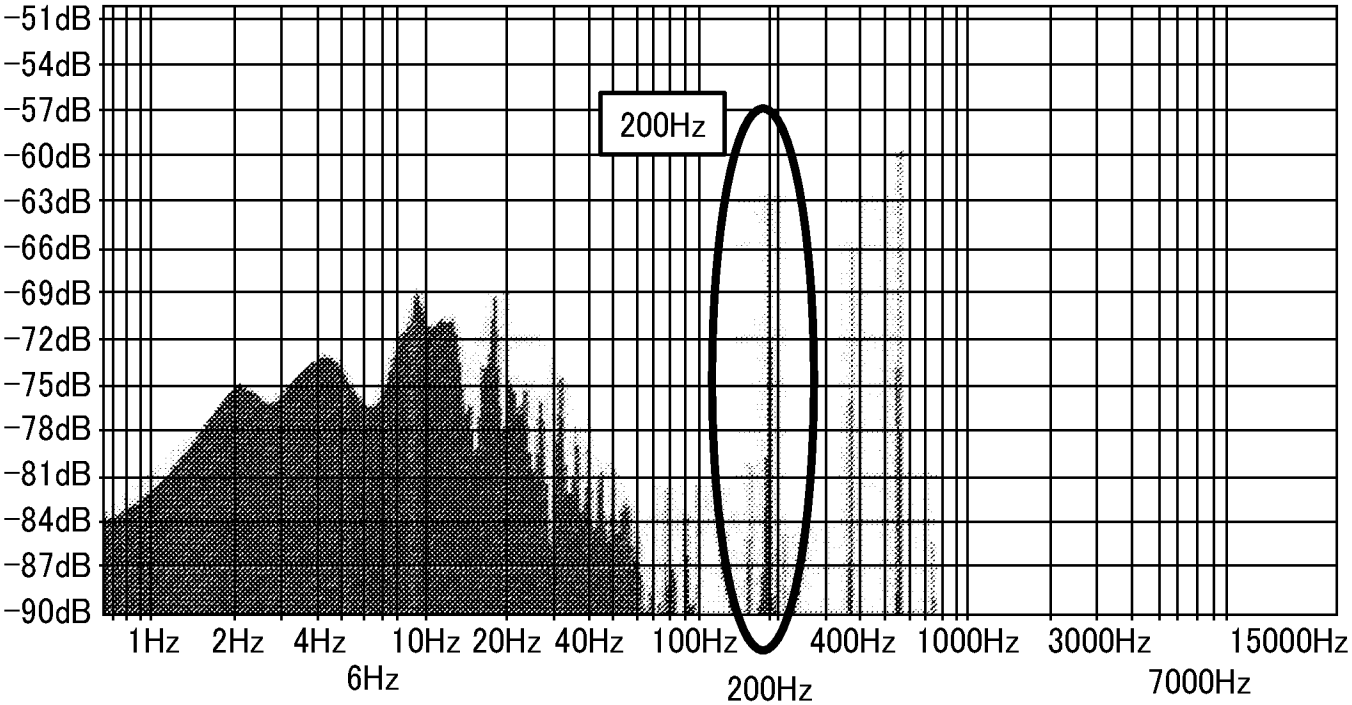
FIG. 6 is a graph of a result of analysis of noise frequency.
Figure 7:
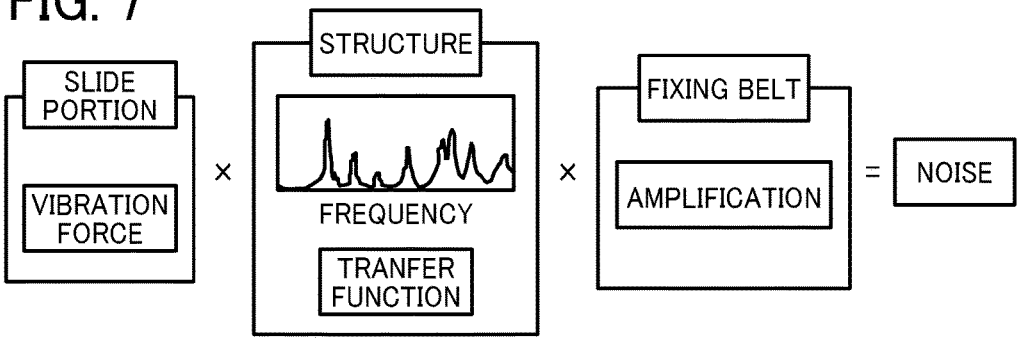
FIG. 7 is a diagram for illustration of a noise generation mechanism.

FIG. 6 is a diagram for describing a conventional disadvantage and a solution for the disadvantage. FIG. 6 is a graph of a result of analysis of noise frequency. Conventionally, a frequency about 200 Hz, for example, is confirmed when the noise frequency analysis is implemented when the noise is generated. Next, a noise generation mechanism will be described with reference to FIG. 7. A vibratory force of vibration is generated at a slide portion which is formed by the inner surface of the fixing belt 31 and the nip formation pad 34. Further, the vibratory force generated at the slide portion is transmitted to the structural body such as the stay 35, and eventually, is amplified to a sound using the fixing belt 31 as a radiation system and becomes the noise. It is possible to measure the vibration occurs at the same frequency as the sound frequency at the time of the actual noise generation. Incidentally, the slide portion formed by the inner surface of the fixing belt 31 and the nip formation pad 34 and the fixing belt 31 serving as the radiation system are in direct contact with each other in the fixing device 30 of the present embodiment, and thus, it is considered the stay 35 as the structural body functions little with respect to the noise.

First Configuration Example

Figure 8:
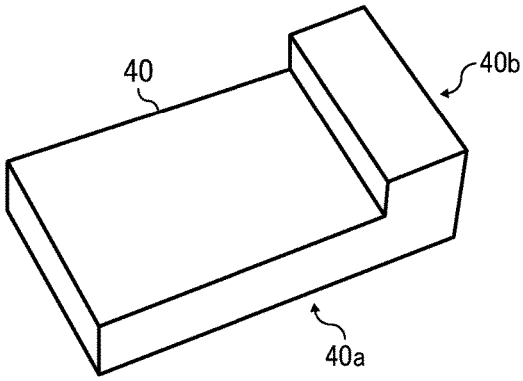
FIG. 8 is an outer perspective view of a vibration repressor to repress vibration of the nip formation pad.
Figure 9:
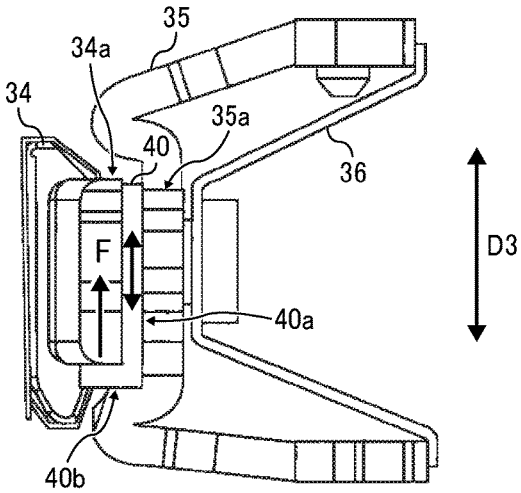
FIG. 9 is a side view of a state in which the vibration repressor is disposed between the nip formation pad and the stay.

FIG. 8 is an outer perspective view of a vibration repressor 40 for repression of vibration of the nip formation pad 34. FIG. 1 is a perspective view of a state in which the nip formation pad 34 and the stay 35 are in contact with each other to provide the vibration repressor 40 between the nip formation pad 34 and the stay 35. FIG. 9 is a side view of a state in which the nip formation pad 34 and the stay 35 are in contact with each other to provide the vibration repressor 40 between the nip formation pad 34 and the stay 35. The vibration in the slide rotation direction D3 of the fixing belt 31 of the nip formation pad 34 is repressed to decay using the vibration repressor 40 as illustrated in FIG. 8 which is an elastic member and is made of a heat-resistant silicone rubber as a heat-resistant member having hardness of 20 degree in the fixing device 30 of the present embodiment.

The vibration repressor 40 includes a plate-shaped body portion 40*a* and a projecting portion 40*b* that protrudes from an end in the long-side direction of the body portion 40*a*, which is on one side face of the body portion 40*a*, and forms an L-shape. Further, the vibration repressor 40 is disposed between an end 34*a* of the nip formation pad 34 and an end 35*a* of the stay 35 in the width direction D1 of the fixing belt 31 such that the body portion 40*a* is pinched between the end 34*a* of the nip formation pad 34 and the end 35*a* of the stay 35 as illustrated in FIGS. 1 and 9. Opposed side ends of the body portion 40*a* of the vibration repressor 40 are in contact with the nip formation pad 34 and the stay 35, respectively, and the body portion 40*a* causes the vibration repressor 40 to absorb the vibratory force causing the vibration of the nip formation pad 34, thereby causing the vibration of the nip formation pad 34 to decay. In addition, the projecting portion 40*b* of the vibration repressor 40 is pinched between the end 34*a* of the nip formation pad 34 and the end 35*a* of the stay 35 in the state of being compressed in the slide rotation direction D3 of the fixing belt 31 as illustrated in FIG. 9. Accordingly, the end 34*a* of the nip formation pad 34 is biased along the slide rotation direction D3 of the fixing belt 31 in the direction indicated by arrow F in FIG. 9 by the elastic force of the projecting portion 40*b* of the vibration repressor 40. Thus, each of the bosses 340 disposed in the opposed face 341 of the nip formation pad 34 abuts on each inner wall face in the slide rotation direction D3 of the fixing belt 31 of the through-holes 350 disposed in the support face 351 of the stay 35, and the nip formation pad 34 is positioned relative to the stay 35 in the slide rotation direction D3 of the fixing belt 31. Such a configuration can more effectively reduce the vibration of the nip formation pad 34 in the slide rotation direction D3 of the fixing belt 31.

In the present configuration example, a positioning unit, which positions the nip formation pad 34 relative to the stay 35 in the slide rotation direction D3 of the fixing belt 31, using the projecting portion 40*b* of the vibration repressor 40, the boss 340 of the nip formation pad 34, the through-hole 350 of the stay 35, and the like. Incidentally, any configuration in which the nip formation pad 34 is biased in the slide rotation direction D3 of the fixing belt 31, and the positioning of the nip formation pad 34 is performed by causing the stay 35 and the nip formation pad 34 to abut on each other in the slide rotation direction D3 of the fixing belt 31 may be disposed as the positioning unit.

Figure 10:
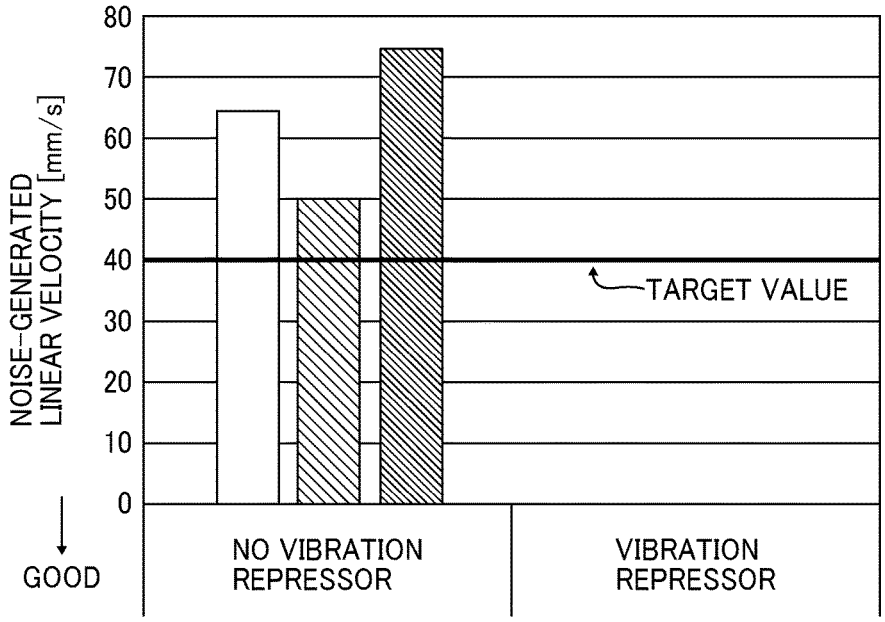
FIG. 10 is a graph of a result of an effect of countermeasure against noise through the vibration repressor.

FIG. 10 is a graph of a result of an effect of a countermeasure against noise through the vibration repressor 40. Incidentally, FIG. 10 illustrates results obtained by performing an evaluation three times under the same condition for each case of presence and absence of the vibration repressor 40. As illustrated in FIG. 10, an effect that it is possible to repress the noise, generated in the state where the vibration repressor 40 is not provided, by providing the vibration repressor 40 between the end 34*a* of the nip formation pad 34 and the end 35*a* of the stay 35 was obtained.

The likelihood of generation of noise is unstable as the likelihood of generation of stick-slip in the slide portion varies depending on a contact state between the fixing belt 31 and the nip formation pad 34 (or the slide sheet) and a lubrication state of a lubricant such as oil and grease. Therefore, there is a case in which the likelihood of generation of noise is unexpectedly changed depending on how to use the fixing device 30. This is because factors such as rotational speed and temperature of the fixing belt 31 are also changed according to a sheet passage mode or the like in addition to the change of the lubrication state over time depending on how to use the fixing device 30. In the current evaluation, the effect was confirmed by designing a heater lighting circuit capable of heating while being rotated by an external drive with respect to the fixing device 30 in a state where the noise is likely to be generated and providing the vibration repressor 40 as described above in the stable noise generation state. Thereafter, the reproducibility of noise generation was also confirmed in the device configuration in which the vibration repressor 40 is detached.

In addition, when a silicone rubber having low heatproof temperature is used as the vibration repressor 40, it is desirable to provide the vibration repressor 40 in a non-sheet-passage area at the outer side of a sheet passage region of a maximum sheet size available in the fixing device 30 on consideration of heat resistance of the vibration repressor 40. This is because there is a possibility that the temperature of the fixing belt 31 rises to about 240° C. and the temperature of the stay 35 rises to about 300° C. due to the heat from the halogen heaters 33*a* and 33*b* depending on a target fixing temperature or the like, for example. Meanwhile, each temperature of the fixing belt 31 and the stay 35 is about 207° C. in the non-sheet-passage area. Thus, it is possible to reduce the influence of heat with respect to the vibration repressor 40 and to improve durability of the vibration repressor 40 as compared to the case of providing the vibration repressor 40 between the nip formation pad 34 and the stay 35 in the sheet passage area. In addition, it is possible to obtain ease of disposition of the vibration repressor 40 and significantly reduce a side effect against fixing properties by providing the vibration repressor 40 in the non-sheet-passage area.

In addition, a heat-resistant silicone rubber, which is a material having high heat resistance with a heatproof temperature of about 240° C. may be used as the vibration repressor 40, a fixing temperature and an attainable temperature of the vibration repressor 40 may be set to be controllable, and the vibration repressor 40 may be disposed in the sheet passage area. The function of the vibration repressor 40 made of the rubber member is realized by securing the vibration repressor 40 to the stay 35 and causing the vibration repressor 40 to absorb the vibratory force generated from the vibration of the nip formation pad 34. Thus, when the vibration repressor 40 is sufficiently pressed against the nip formation pad 34 and the stay 35 by the pressing force from the pressure roller 32, it is possible to prevent drop of the vibration repressor 40 by a frictional force generated between each of the nip formation pad 34 and the stay 35 and the vibration repressor 40. Such a configuration obviates bonding of the vibration repressor 40 to the stay 35 using an adhesive having heat resistance or the like, thus facilitating the arrangement of the vibration repressor 40.

Second Configuration Example

Figure 11:
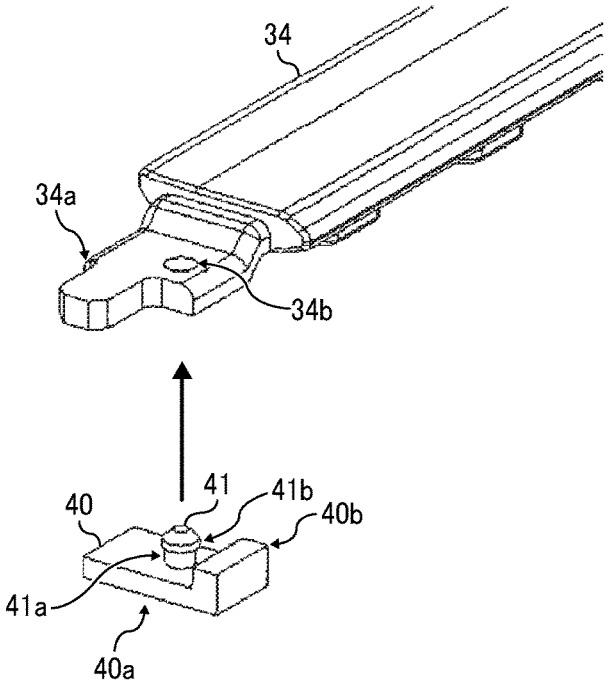
FIG. 11 is an illustration of a case in which a vibration repressor according to a second configuration example is attached to an end of a nip formation pad.
Figure 12:
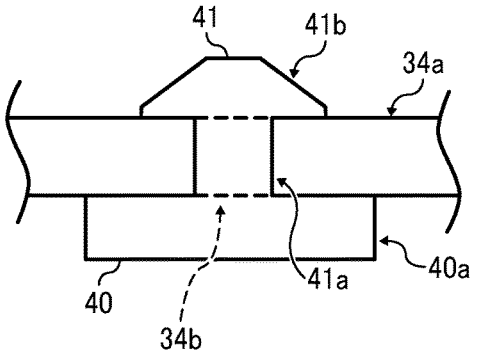
FIG. 12 is a diagram of a state in which the vibration repressor according to the second configuration example is secured by the end of the nip formation pad.
Figure 21:
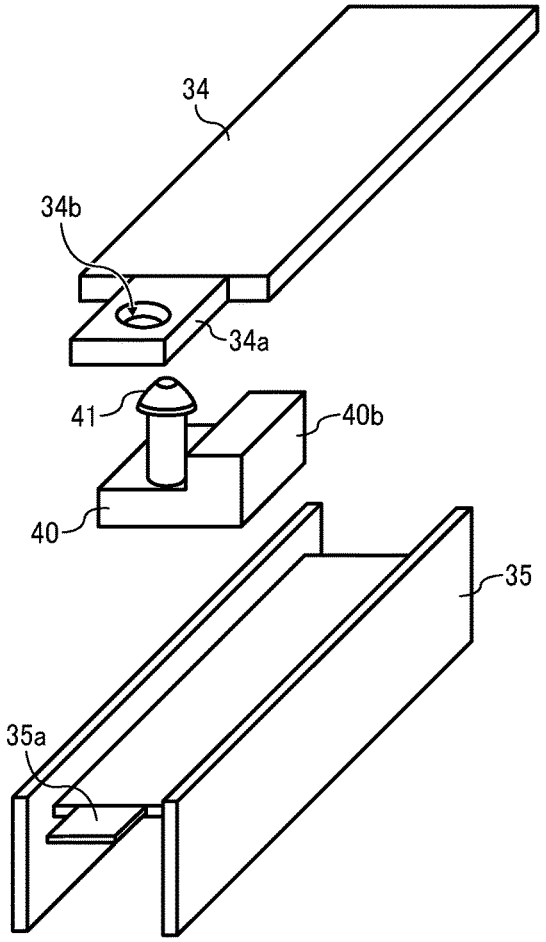
FIG. 21 is an exploded perspective view of each portion of the vibration repressor, the nip formation pad, and a stay according to the second configuration example.
Figure 22:
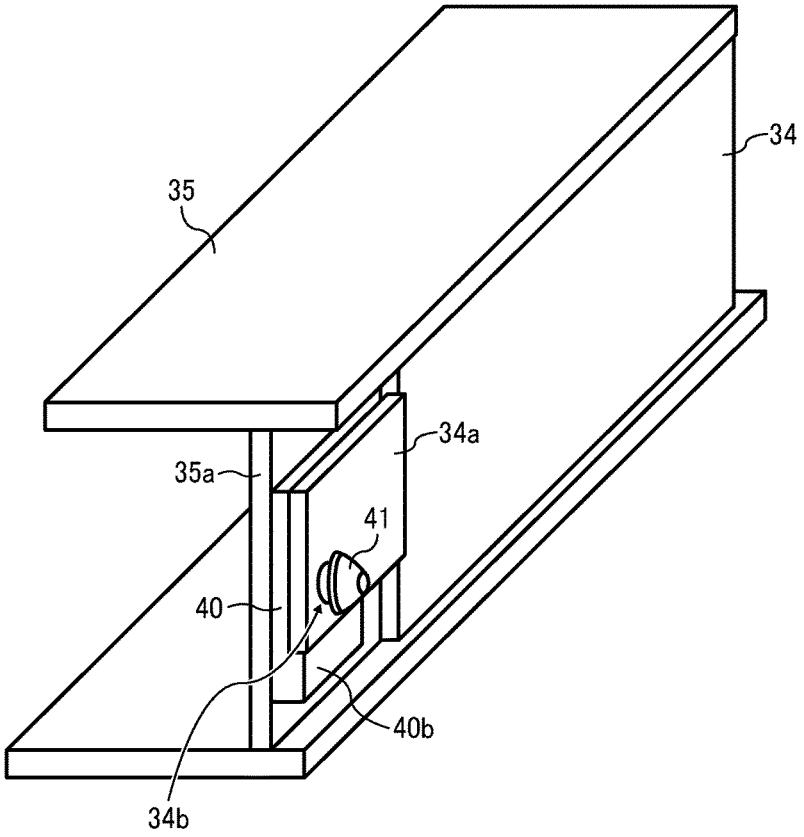
FIG. 22 is a perspective view of each portion of the vibration repressor, the nip formation pad, and the stay according to the second configuration example.

FIG. 21 is an exploded perspective view of each portion of the vibration repressor 40, the nip formation pad 34, and the stay 35 according to a second configuration example. FIG. 22 is a perspective view of each portion of the vibration repressor 40, the nip formation pad 34, and the stay 35 according to the second configuration example. In addition, FIG. 11 is an illustration of a case in which the vibration repressor 40 is attached to the end of the nip formation pad 34 according to the second configuration example. As illustrated in FIGS. 11 and 21, a projection 41 may be disposed on a side face of the body portion 40*a* on a side on which the projecting portion 40*b* of the vibration repressor 40 is formed so as to project from the side face. The projection 41 includes a cylindrical portion 41*a* and a conical portion 41*b*. The conical portion 41*b* is disposed at a leading end side of the cylindrical portion 41*a* and serves as an engaging portion having a bottom face of a larger diameter than a diameter of the cylindrical portion 41*a*. An engagement hole 34*b* with which the projection 41 is engaged is disposed in the end 34*a* of the nip formation pad 34, and the projection 41 is inserted into the engagement hole 34*b* while being elastically deformed to compress the conical portion 41*b*. Further, when the projection 41 is inserted until the conical portion 41*b* exits the engagement hole 34*b* and is engaged with the engagement hole 34*b*, the restored bottom face of the conical portion 41*b* is caught by an edge of the engagement hole 34*b*, and the vibration repressor 40 is secured by the end 34*a* of the nip formation pad 34 as illustrated in FIGS. 12 and 22. In such a manner, it is possible to more reliably prevent the drop of the vibration repressor 40 between the nip formation pad 34 and the stay 35 at the time of depressurization operation which is performed to secure durability of the pressure roller 32 by securing the vibration repressor 40 to the nip formation pad 34 using the projection 41. In addition, the pressing force of the pressure roller 32 is applied from the nip formation pad 34 toward the stay 35. Thus, the pressing force of the pressure roller 32 acts in a direction of causing the conical portion 41*b* to be engaged with the engagement hole 34*b* by securing the vibration repressor 40 in the above-described manner, and the attachment between the vibration repressor 40 and the nip formation pad 34 is hardly detached. Therefore, it is possible to prevent the drop of the vibration repressor 40 between the nip formation pad 34 and the stay 35, for example, even when a slide torque increases and great vibration is applied at the time of pressing of the pressure roller 32 or when vibration, which is different from that of normal usage time is applied to the nip for paper jam processing (JAM processing). In addition, it is possible to achieve simplification of the securing work as compared to the case of bonding the vibration repressor 40 to the end 34*a* of the nip formation pad 34 using an adhesive to perform the securing. In addition, an engagement hole with which the projection 41 is engaged may be disposed in the stay 35 so that the conical portion 41*b* is hooked by the stay 35 and secured.

In addition, it is preferable that the frictional force between the vibration repressor 40 and the nip formation pad 34, and the frictional force between the vibration repressor 40 and the stay 35 be great. It is possible to further enhance the effect of preventing the vibration repressor 40 from dropping from the portion between the nip formation pad 34 and the stay 35 as the misalignment hardly occurs by increasing the frictional force between the nip formation pad 34 and the stay 35. In addition, it is possible to enhance the effect of repressing the generation of noise by increasing the frictional force between the nip formation pad 34 and the stay 35.

Figure 23:
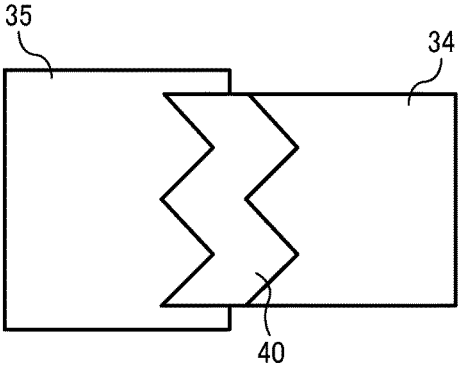
FIG. 23 is a diagram of an example of a configuration in which a frictional force between the vibration repressor and the nip formation pad and a frictional force between the vibration repressor and the stay are increased.

FIG. 23 is a diagram of an example of a configuration in which the frictional force between the vibration repressor 40 and the nip formation pad 34 and the frictional force between the vibration repressor 40 and the stay 35 are increased. In the example illustrated in FIG. 23, the vibration repressor 40 is formed in a wavy shape in cross section where a mountain and a valley are alternately continuous, and a contact face of the nip formation pad 34 with which the vibration repressor 40 is in contact and a contact face of the stay 35 with which the vibration repressor 40 is in contact are formed in an uneven shape including convex portions and concave portions. Accordingly, the frictional force between the vibration repressor 40 and the nip formation pad 34 and the frictional force between the vibration repressor 40 and the stay 35 are increased, and the misalignment hardly occurs. Accordingly, it is possible to prevent the drop of the vibration repressor 40 between the nip formation pad 34 and the stay 35. In addition, it is also possible to enhance the effect of repressing the generation of noise. In addition, it is possible to strengthen the frictional force between the vibration repressor 40 and the nip formation pad 34 and the frictional force between the vibration repressor 40 and the stay 35 when the unevenness is disposed on the surface of the vibration repressor 40, the contact face of the nip formation pad 34 to which the vibration repressor 40 is in contact and the contact face of the stay 35 to which the vibration repressor 40 is in contact. Accordingly, the surface of the vibration repressor 40 is roughened by roughening a mold when the vibration repressor 40 is molded by injection molding or the like, for example. In addition, the face of the nip formation pad 34 with which the vibration repressor 40 is in contact and the contact face of the stay 35 with which the vibration repressor 40 is in contact may be subjected to sandblasting or the like so that these contact faces are roughened.

Second Embodiment

The image forming apparatus 1000 according to a second embodiment of the present disclosure will be described below. Here, a basic configuration of the image forming apparatus 1000 according to the second embodiment is the same as the configuration of the image forming apparatus 1000 according to the first embodiment, and thus, redundant descriptions thereof will be omitted.

Figure 13A:
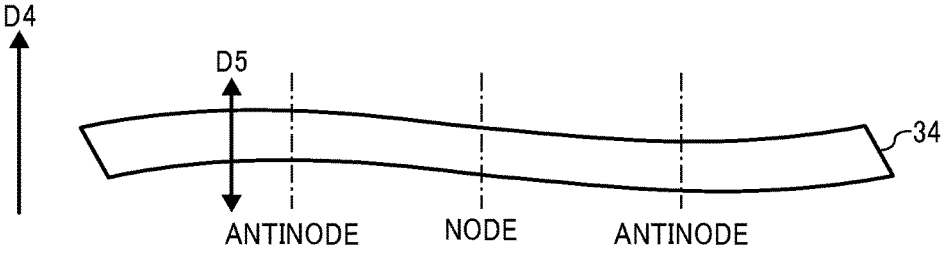
FIGS. 13A and 13B are diagrams of vibration modes of the nip formation pad at the time of noise generation.
Figure 13B:
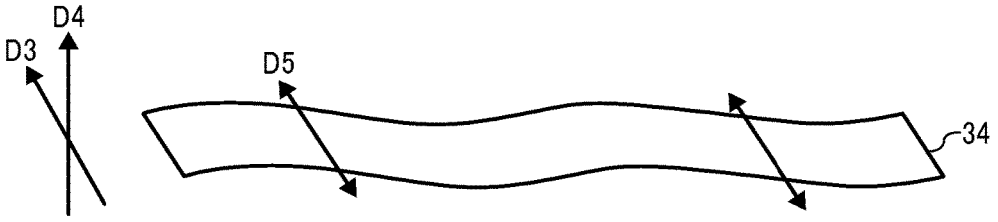

A nip formation pad 34 vibrates in a specific vibration mode at the time of noise generation, and FIGS. 13A and 13B illustrate state in a representative vibration mode. Incidentally, the presence of vibration modes other than the vibration mode illustrated in FIGS. 13A and 13B has been known upon calculation.

A first vibration mode illustrated in FIG. 13A is a case in which a pressing direction of a pressure roller 32 indicated by arrow D4 and a vibration direction of the nip formation pad 34 indicated by arrow D5 are the same. In the first vibration mode, the nip formation pad 34 is pinched by the pressure roller 32 and a stay 35 in the pressing direction D4 of the pressure roller 32, and vibration in the same direction as the pressing direction D4 is hardly generated in the nip formation pad 34. On the other hand, a second vibration mode illustrated in FIG. 13B is a case in which the slide rotation direction D3 of a fixing belt 31 and the nip formation pad 34 and the vibration direction D5 of the nip formation pad 34 are the same. In the second vibration mode, it is considered that vibration in the same direction as the slide rotation direction D3 is easily generated in the nip formation pad 34 due to stick-slip which likely occurs between the fixing belt 31 and the nip formation pad 34.

Third Configuration Example

Figure 14:
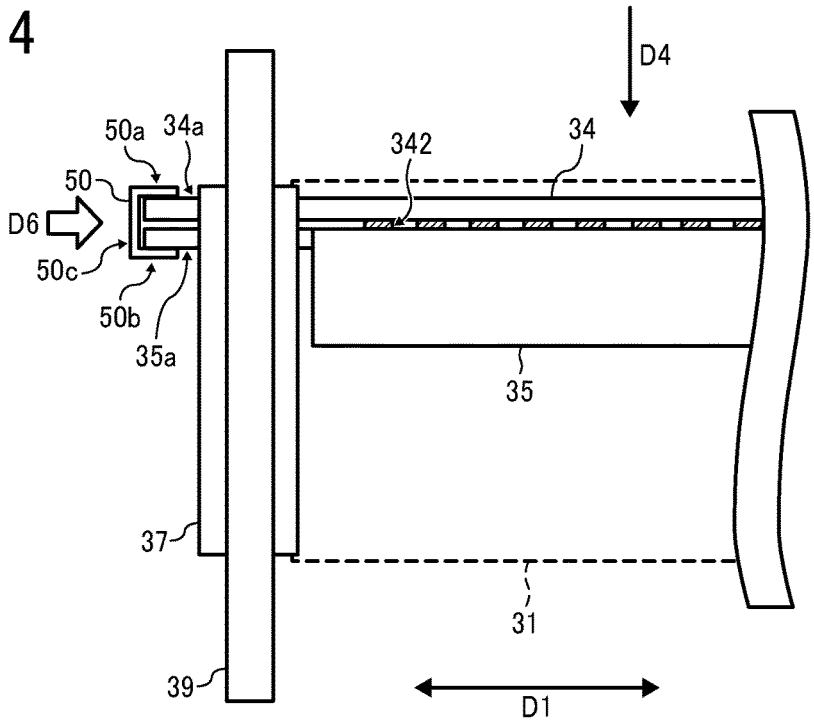
FIG. 14 is a diagram of a configuration in which a nip formation pad and a stay in a fixing device according to a third configuration example are held by a stopper.

FIG. 14 is a diagram of a configuration in which the nip formation pad 34 and the stay 35 in a fixing device 30 according to a third configuration example is held by a stopper 50. In the present configuration example, an end 34*a* of the nip formation pad 34 and an end 35*a* of the stay 35 extend to a non-sheet-passage area which is an outer side in the width direction D1 of the fixing belt 31 than a side plate 39 holding the nip formation pad 34 and the stay 35 as illustrated in FIG. 14. In addition, the stopper 50 to hold the nip formation pad 34 and the stay 35 is provided. The stopper 50 includes a pair of pinching portions 50*a* and 50*b*, which extend in the width direction D1 of the fixing belt 31, and a base portion 50*c* which extends in the pressing direction D4 of the pressure roller 32 and has opposed ends at which the pinching portions 50*a* and 50*b* are provided, respectively. Further, the end 34*a* of the nip formation pad 34 and the end 35*a* of the stay 35 are pinched by the pinching portion 50*a* and the pinching portion 50*b* of the stopper 50, and accordingly, the nip formation pad 34 and the stay 35 are held by the stopper 50.

Here, a high-temperature state of about 300° C. is formed in the sheet passage area inside the fixing device 30, and thus, it is not preferable to completely hold the nip formation pad 34 made of resin such as a liquid crystal polymer and the stay 35 made of metal such as iron and stainless steel which have different linear thermal expansion coefficients, for example. This is because thermal stress is applied to the nip formation pad 34 due to the difference between the linear expansion coefficients of the nip formation pad 34 and the stay 35, and a premature failure of the fixing device 30 and degradation of image quality are induced due to deformation of the nip formation pad 34 and non-uniformity of a pressing force inside a fixing nip N. Meanwhile, it has been found out that to hold the end 34*a* of the nip formation pad 34 and the end 35*a* of the stay 35 using the stopper 50 in the non-sheet-passage area is advantageous from a viewpoint of the ease of disposition of the stopper 50 and preventing a side effect of thermal expansion and a side effect against the fixing properties as a result of repeating diligent studies conducted by the inventors of the present application. Thus, the vibration of the nip formation pad 34 generated in the same direction as the slide rotation direction D3 is repressed by pinching and holding the end 34*a* of the nip formation pad 34 and the end 35*a* of the stay 35 using the stopper 50 in the non-sheet-passage area in the present configuration example. Accordingly, it is possible to repress the generation of noise caused by the vibration of the nip formation pad 34.

Incidentally, the influence of heat from the halogen heaters 33*a* and 33*b* is the least in the non-sheet-passage area at the outer side in the width direction D1 of the fixing belt 31 than the side plate 39, and a selection range of a material to be used for the stopper 50 is wide, and the stopper 50 is not necessarily made of metal. However, it is desirable that the stopper 50 have an appropriate elasticity in order to exert the holding force. The influence of the linear thermal expansion of the nip formation pad 34 and the stay 35 in a heating area of the fixing belt 31 by the halogen heaters 33*a* and 33*b* also affect on the end 34*a* of the nip formation pad 34 and the end 35*a* of the stay 35. However, it is possible to cause the stopper 50 to absorb the influence of the thermal expansion while holding the nip formation pad 34 and the stay 35 with the appropriate elasticity of the stopper 50.

In addition, the stopper 50 exerts the holding force with respect to the nip formation pad 34 and the stay 35 in the pressing direction D4 of the pressure roller 32 in FIG. 14. In such a configuration, it is also possible to reduce the vibration caused by the stick-slip occurring in the slide rotation direction D3 by holding the nip formation pad 34 and the stay 35 with the stopper 50 using the frictional force generated between each of the nip formation pad 34 and the stay 35, and the stopper 50. In addition, a high-friction-coefficient member (for example, a heat-resistant silicone rubber or the like), which has a higher friction coefficient relative to the nip formation pad 34 and the stay 35 than the stopper 50, may be bonded to adhere on each face of the stopper 50, which is in contact with each of the nip formation pad 34 and the stay 35, in advance. Accordingly, it is possible to further enhance the frictional force at each contact point and exert a stronger holding force between the stopper 50 and the nip formation pad 34 and between the stopper 50 and the stay 35 using the high-friction-coefficient member interposed therebetween.

Meanwhile, it is also desirable to directly exert the holding force using the stopper 50 with respect to the nip formation pad 34 and the stay 35 in the vibration direction D5 which is the same direction as the slide rotation direction D3 in the assumed vibration mode. It is desirable to suitably optimize whether to exert the holding force in the pressing direction D4 of the pressure roller 32 or to exert the holding force in the slide rotation direction D3 based on a margin of disposition on design of the stopper 50 or the like.

First Variation

Figure 15:
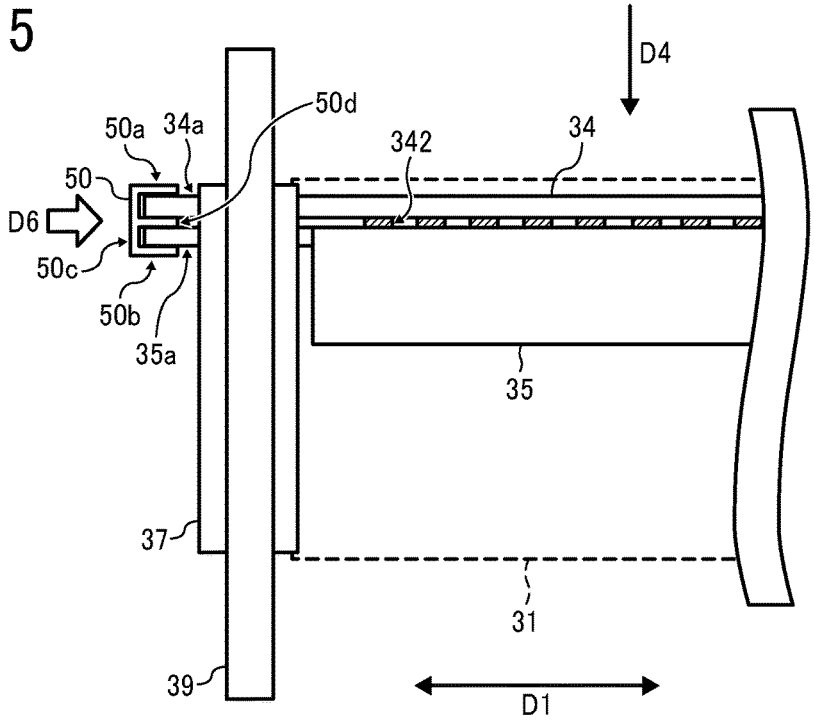
FIG. 15 is a diagram of a configuration in which a nip formation pad and a stay in a fixing device according to a first variation are held by a stopper.

Incidentally, a pinching portion 50*d* may be disposed between the pinching portion 50*a* and the pinching portion 50*b* of the stopper 50 so that the pinching portion 50*d* is pinched between the end 34*a* of the nip formation pad 34 and the end 35*a* of the stay 35 as illustrated in FIG. 15. Accordingly, a frictional force generated between each of the end 34*a* of the nip formation pad 34 and the end 35*a* of the stay 35, and the pinching portion 50*d* of the stopper 50 further acts on the stopper 50 according to the first configuration example. Thus, it is possible to more reliably hold the nip formation pad 34 and the stay 35 using the stopper 50 and to repress the generation of noise caused by the vibration of the nip formation pad 34.

Fourth Configuration Example

Figure 16:
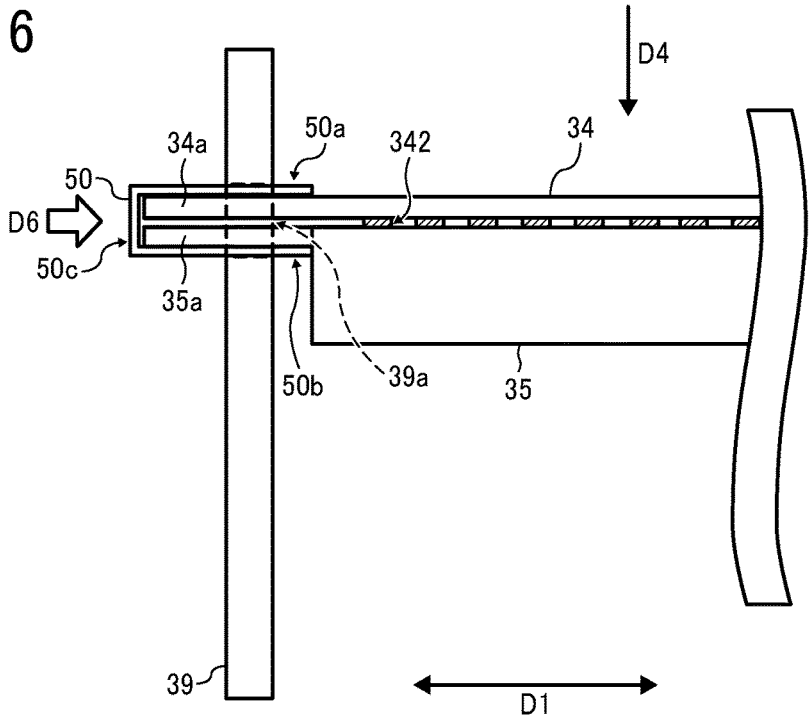
FIG. 16 is a diagram of a configuration in which a nip formation pad and a stay in a fixing device according to a fourth configuration example are held by a stopper.

FIG. 16 is a diagram of a configuration in which the nip formation pad 34 and the stay 35 in the fixing device 30 according to the fourth configuration example are held by the stopper 50. In the present configuration example, the pinching portions 50*a* and 50*b* of the stopper 50 are disposed to extend to the inner side in the width direction D1 of the fixing belt 31 than the side plate 39 as illustrated in FIG. 16. In addition, engagement holes 39*a* each of which is engaged with the end 34*a* of the nip formation pad 34, the end 35*a* of the stay 35, and the pinching portions 50*a* and 50*b* of the stopper 50 are opened in the side plate 39. Further, the end 34*a*, the end 35*a*, and the pinching portions 50*a* and 50*b* are engaged with the engagement holes 39*a* such that the end 34*a* of the nip formation pad 34 and the end 35*a* of the stay 35 are interposed by the pinching portions 50*a* and 50*b*, and the nip formation pad 34 and the stay 35 are held by the stopper 50. Accordingly, the drop of the stopper 50 is prevented, and it is possible to repress the generation of noise by exerting the holding effect using the appropriate elasticity and reducing the vibration of the nip formation pad 34.

Fifth Configuration Example

Figure 17:
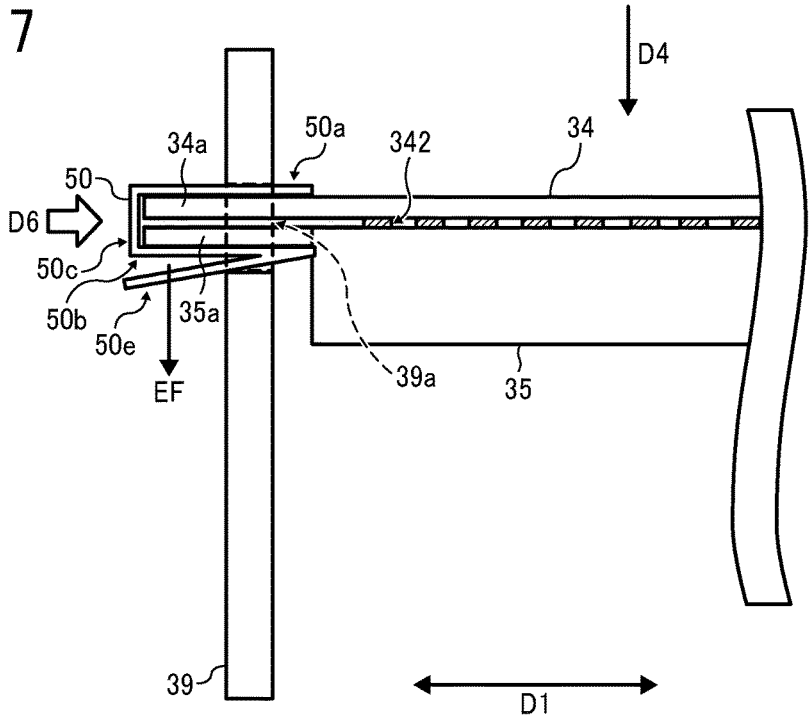
FIG. 17 is a diagram of a configuration in which a nip formation pad and a stay in a fixing device according to a fifth configuration example are held by a stopper.
Figure 18:
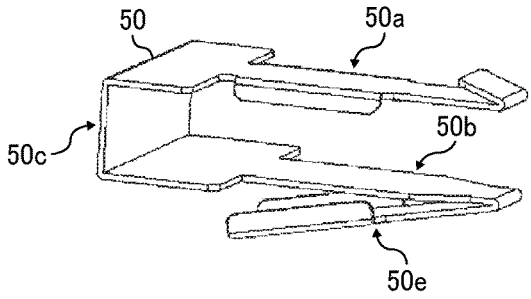
FIG. 18 is a perspective view of the stopper according to the fifth configuration example.

FIG. 17 is a diagram of a configuration in which the nip formation pad 34 and the stay 35 in the fixing device 30 according to a fifth configuration example are held by the stopper 50. FIG. 18 is a perspective view of the stopper 50 according to the fifth configuration example. In the present configuration example, a flat spring portion 50*e* is disposed in the pinching portion 50*b* of the stopper 50 as illustrated in FIGS. 17 and 18. Further, the pinching portion 50*a* of the stopper 50 is inserted in a direction indicated by arrow D6 between the end 34*a* of the nip formation pad 34 and an inner wall face of the side plate 39 in the pressing direction D4 of the pressure roller 32 inside the engagement hole 39*a* of the side plate 39. In addition, the pinching portion 50*b* and the flat spring portion 50*e* of the stopper 50 are inserted in the direction D6 between the end 35*a* of the stay 35 and the inner wall face of the side plate 39. Accordingly, the end 34*a* of the nip formation pad 34 and the end 35*a* of the stay 35 are interposed by the pinching portions 50*a* and 50*b* of the stopper 50. Such a configuration can more reliably exert the holding force with respect to the end 34*a* of the nip formation pad 34 and the end 35*a* of the stay 35 using an elastic force, which is indicated by arrow EF in FIG. 17, of the flat spring portion 50*e* of the stopper 50.

Second Variation

Figure 19:
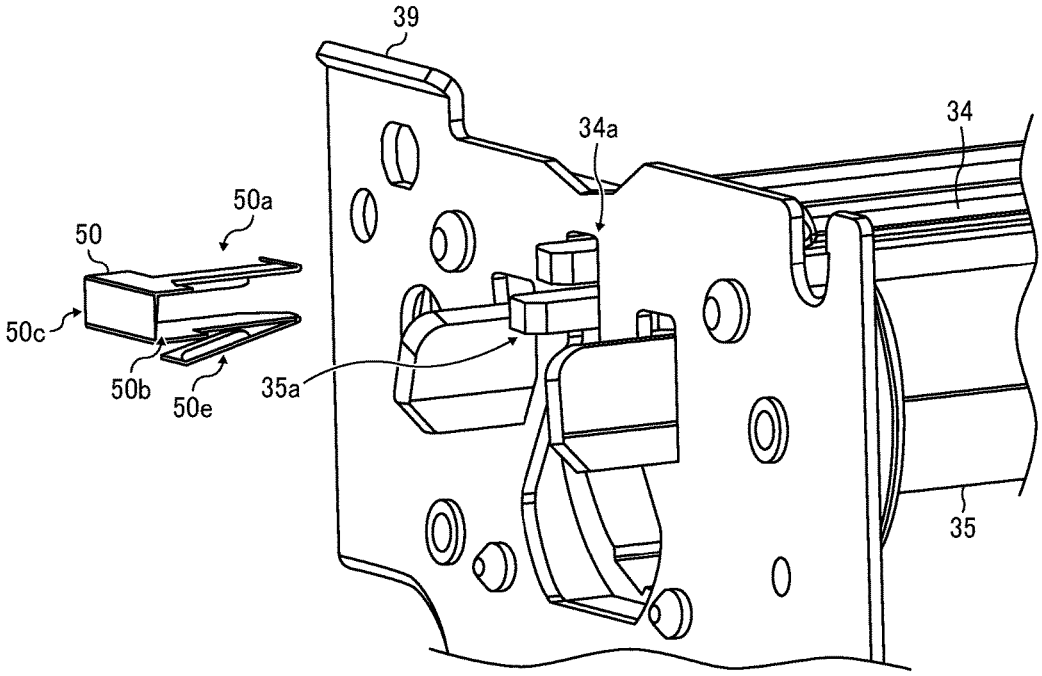
FIG. 19 is a diagram of a configuration in which a nip formation pad and a stay in a fixing device according to a second variation are held by a stopper.

Incidentally, the pinching portion 50*b* and the flat spring portion 50*e* of the stopper 50 may be inserted between the end 34*a* of the nip formation pad 34 and the end 35*a* of the stay 35 in the pressing direction D4 of the pressure roller 32 inside the engagement hole 39*a* of the side plate 39 as illustrated in FIG. 19.

Figure 20:
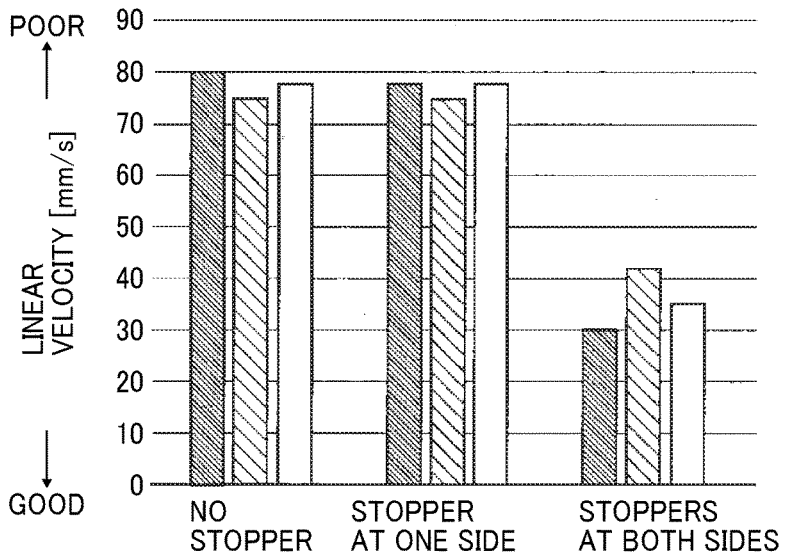
FIG. 20 is a graph of a result of an effect of a countermeasure against noise through the stopper.

FIG. 20 is a graph of a result of an effect of a countermeasure against noise through the stopper 50 according to the present embodiment. Incidentally, FIG. 20 illustrates results obtained by performing an evaluation three times under the same condition for each case of absence of the stopper 50, presence of the stopper 50 on a single side, and presence of the stoppers 50 on both sides. As illustrated in FIG. 20, the effect of the countermeasure against noise that the rotational speed (linear velocity) of the fixing belt 31 at which the noise is generated is delayed by holding the nip formation pad 34 and the stay 35 using the stopper 50, as compared to a case in which the nip formation pad 34 and the stay 35 are not held by the stopper 50, was obtained. The rotational speed of the fixing belt 31 greatly affects on the service life thereof, and the service life of the fixing belt 31 expires early as the rotation time at high speed increases, which is not preferable from a viewpoint of economic efficiency. Thus, it is possible to achieve the increase in service life of the fixing belt 31 as much as it is possible to delay the rotational speed (linear velocity) of the fixing belt 31 to cause the noise generation by holding the nip formation pad 34 and the stay 35 using the stopper 50. In addition, the effect of enabling the rotational speed (linear velocity) of the fixing belt 31 to cause the noise generation to be delayed is higher in the case of holding both the nip formation pad 34 and the stay 35 using the stopper 50 than the case of holding only one of the nip formation pad 34 and the stay 35 using the stopper 50 as apparent from FIG. 20.

The likelihood of generation of noise is unstable as the likelihood of generation of stick-slip in the slide portion varies depending on a contact state between the fixing belt 31 and the nip formation pad 34 (or the slide sheet) and a lubrication state of a lubricant such as oil and grease. Therefore, there is a case in which the likelihood of generation of noise is unexpectedly changed depending on how to use the fixing device 30. This is because factors such as rotational speed and temperature of the fixing belt 31 are also changed depending on a sheet passage mode or the like in addition to the change of the lubrication state over time depending on how to use the fixing device 30. In the current evaluation, the effect was confirmed by designing a heater lighting circuit capable of heating while being rotated by an external drive with respect to the fixing device 30 in a state where the noise is likely to be generated and providing the stopper 50 as described above in the stable noise generation state.

Thereafter, the reproducibility of noise generation was also confirmed in the device configuration in which the vibration repressor 40 is detached.

The above description is illustrative, and a unique effect is achieved with each of the following aspects.

Aspect A

A fixing device, such as the fixing device 30, includes: an endless, rotatable fixing belt, such as the fixing belt 31; a pressure rotator, such as the pressure roller 32, to press an outer surface of the fixing belt; a nip formation pad, such as the nip formation pad 34, disposed at an inner side of the fixing belt, to abut on the pressure rotator with the fixing belt interposed between the nip formation pad and the pressure rotator, to form a fixing nip; a support, such as the stay 35, disposed at the inner side of the fixing belt, to support the nip formation pad; and a vibration repressor, such as the vibration repressor 40, to repress vibration of the nip formation pad disposed between the nip formation pad and the support. In Aspect A, the vibration repressor disposed between the nip formation pad and the support causes the vibration of the nip formation pad caused by a vibratory force generated due to rubbing between the nip formation pad and the fixing belt to decay or the like, thereby repressing the vibration of the nip formation pad. Such a configuration can repress occurrence of a phenomenon in which the vibration of the nip formation pad is transmitted via the support and eventually is amplified at the fixing belt. Accordingly, generation of noise caused by the vibration of the nip formation pad can be repressed.

Aspect B

A fixing device, such as the fixing device 30, includes: an endless, rotatable fixing belt, such as the fixing belt 31; a pressure rotator, such as the pressure roller 32, to press an outer surface of the fixing belt; a nip formation pad, such as the nip formation pad 34, disposed at an inner side of the fixing belt, to abut on the pressure rotator with the fixing belt interposed between the nip formation pad and the pressure rotator to form a fixing nip; a support, such as the stay 35, disposed at the inner side of the fixing belt, to support the nip formation pad; and a stopper, such as the stopper 50, to hold the nip formation pad and the support. In Aspect B, the nip formation pad and the support are held by the stopper. Such a configuration can repress the vibration of the nip formation pad caused by a vibratory force generated due to rubbing between the rotating fixing belt and the nip formation pad. Accordingly, generation of noise caused by the vibration of the nip formation pad can be repressed.

Aspect C

A fixing device, such as the fixing device 30, includes: an endless, rotatable fixing belt, such as the fixing belt 31; a pressure rotator, such as the pressure roller 32, to press an outer surface of the fixing belt; a nip formation pad, such as the nip formation pad 34, disposed at an inner side of the fixing belt, to abut on the pressure rotator with the fixing belt interposed between the nip formation pad and the pressure rotator to form a fixing nip; a support, such as the stay 35, disposed at the inner side of the fixing belt, to support the nip formation pad; and a positioning unit to position the nip formation pad relative to the support in a rotation direction of the fixing belt in the fixing nip. The positioning unit includes the projecting portion 40*b* of the vibration repressor 40, the boss 340 of the nip formation pad, the through-hole 350 of the stay 35, and the like. In Aspect C, the position of the nip formation pad in the rotation direction of the fixing belt in the fixing nip is determined with respect to the support, by the positioning unit. Such a configuration can repress the vibration of the nip formation pad in the same direction as the rotation direction of the fixing belt, which is caused by a vibratory force generated due to rubbing between the rotating fixing belt and the nip formation pad. Accordingly, generation of noise caused by the vibration of the nip formation pad can be repressed.

Aspect D

In Aspect A, the vibration repressor is an elastic member. Such a configuration can cause the vibration of the nip formation pad to decay using the vibration repressor and repress the vibration of the nip formation pad as described regarding the above-described embodiments.

Aspect E

In Aspect A or Aspect D, the vibration repressor is a heat-resistant member. Such a configuration can grant the heat resistance to the vibration repressor as described in the above-described embodiments.

Aspect F

In Aspect D or Aspect E, the vibration repressor is made of heat-resistant silicone rubber. Such a configuration can repress the vibration of the nip formation pad by causing the vibration of the nip formation pad to decay using the vibration repressor and grant the heat resistance to the vibration repressor as described regarding the above-described embodiments.

Aspect G

In Aspect A, Aspect D, Aspect E or Aspect F, the vibration repressor is disposed between the nip formation pad and the support, outside a sheet passage area of a sheet having a maximum sheet size available in the fixing device. Such a configuration can decrease influence of heat and improve durability of the vibration repressor as described regarding the above-described embodiments.

Aspect H

In Aspect A, Aspect D, Aspect E, Aspect F or Aspect G, the vibration repressor is not bonded to any of the nip formation pad and the support. Such a configuration can more easily hold the vibration repressor using a pressing force of a contact member as described regarding the above-described embodiments.

Aspect I

In Aspect A, Aspect D, Aspect E, Aspect F, Aspect G or Aspect H, the vibration repressor includes an engaging portion to be engaged with the nip formation pad. Such a configuration can prevent the vibration repressor from dropping at the time of decompression as described regarding the above-described embodiments.

Aspect J

In Aspect I, the nip formation pad or the support has an engagement hole. The engaging portion is disposed at a leading end of a shaft-shaped projection of the vibration repressor, to be engaged with the engagement hole. Such a configuration can prevent the vibration repressor from dropping at the time of decompression as described regarding the above-described embodiments.

Aspect K

In Aspect A, Aspect D, Aspect E, Aspect F, Aspect G, Aspect H, Aspect I or Aspect J, at least one of a contact portion between the nip formation pad, such as the nip formation pad 34, and the vibration repressor, such as the vibration repressor 40, and a contact portion between the support, such as the stay 35, and the vibration repressor has an uneven shape. Such a configuration can increase a frictional force between the vibration repressor and the nip formation pad and a frictional force between the vibration repressor and the support as described regarding the above-described embodiments. Such a configuration can prevent the drop of the vibration repressor between the nip formation pad and the support, and to enhance the effect of repressing the generation of noise.

Aspect L

In Aspect B, each of the nip formation pad and the support at least partially extends outside a sheet passage area of a sheet having a maximum sheet size available in the fixing device, and each of the nip formation pad and the support is held by the stopper at a portion extending outside the sheet passage area. Such a configuration can absorb thermal expansion at an endmost portion and hold the nip formation pad and the support as described regarding the above-described embodiments.

Aspect M

In Aspect B or Aspect L, the stopper pinches the nip formation pad and the support to hold the nip formation pad and the support, and a heat-resistant resin having a higher friction coefficient than a friction coefficient of the stopper relative to the nip formation pad and the support is disposed between the stopper and each of the nip formation pad and the support. Such a configuration can improve the holding force caused by the friction as described regarding the above-described embodiments.

Aspect N

In Aspect M, the heat-resistant resin is bonded the stopper. Such a configuration can further enhance the frictional force at a contact point and exert the stronger holding force as described regarding the above-described embodiments.

Aspect O

In Aspect B, Aspect L, Aspect M or Aspect N, the fixing device includes a side plate, such as the side plate 39, to hold at least one of the nip formation pad and the support, and the stopper extends to the side plate and is held by the side plate. Such a configuration can prevent the drop of the stopper as described regarding the above-described embodiments.

Aspect P

In Aspect O, the stopper includes a flat spring portion, and the stopper is held by the side plate with an elastic force generated in the flat spring portion. Such a configuration can more reliably exert the holding force as described regarding the above-described embodiments.

Aspect Q

In Aspect P, the flat spring portion includes a heat-resistant resin having a higher friction coefficient than a friction coefficient of the stopper relative to each of the nip formation pad and the support. Such a configuration can exert the stronger holding force as described regarding the above-described embodiments.

Aspect R

An image forming apparatus includes an image forming device to form an image on a recording medium and a fixing device to fix the image on the recording medium. The fixing device is any one of Aspect A to Aspect Q. Such a configuration can reduce the vibration of the nip formation pad and repress the generation of noise as described regarding the above-described embodiments.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

an endless, rotatable fixing belt;

a pressure rotator to press an outer surface of the fixing belt;

a nip formation pad disposed at an inner side of the fixing belt, to abut on the pressure rotator with the fixing belt interposed between the nip formation pad and the pressure rotator to form a fixing nip;

a support disposed at the inner side of the fixing belt, to support the nip formation pad; and a vibration repressor comprising an elastic member that is disposed between the nip formation pad and the support, to repress vibration of the nip formation pad.

2. The fixing device according to claim 1, wherein the vibration repressor is a heat-resistant member.

3. The fixing device according to claim 1, wherein the vibration repressor is made of heat-resistant silicone rubber.

4. The fixing device according to claim 1, wherein the vibration repressor is disposed between the nip formation pad and the support, outside a sheet passage area of a sheet having a maximum sheet size available in the fixing device.

5. The fixing device according to claim 1, wherein the vibration repressor is not bonded to any of the nip formation pad and the support.

6. The fixing device according to claim 1, wherein the vibration repressor includes an engaging portion to be engaged with at least one of the nip formation pad and the support.

7. The fixing device according to claim 6, wherein one of the nip formation pad and the support has an engagement hole, and wherein the engaging portion is disposed at a leading end of a shaft-shaped projection of the vibration repressor, and the engaging portion is engaged into the engagement hole.

8. The fixing device according to claim 1, wherein at least one of a contact portion between the nip formation pad and the vibration repressor and a contact portion between the support and the vibration repressor has an uneven shape.

9. An image forming apparatus comprising:

an image forming device to form an image on a recording medium; and the fixing device according to claim 1 to fix the image on the recording medium.

10. A fixing device comprising:

an endless, rotatable fixing belt;

a pressure rotator to press an outer surface of the fixing belt;

a nip formation pad disposed at an inner side of the fixing belt, to abut on the pressure rotator with the fixing belt interposed between the nip formation pad and the pressure rotator to form a fixing nip;

a support disposed at the inner side of the fixing belt, to support the nip formation pad; and a stopper holding the nip formation pad and the support.

11. The fixing device according to claim 10, wherein each of the nip formation pad and the support at least partially extends outside a sheet passage area of a sheet having a maximum sheet size available in the fixing device, and wherein each of the nip formation pad and the support is held by the stopper at a portion extending outside the outside the sheet passage area.

12. The fixing device according to claim 10, wherein the stopper pinches the nip formation pad and the support to hold the nip formation pad and the support, and wherein a heat-resistant resin having a higher friction coefficient than a friction coefficient of the stopper relative to the nip formation pad and the support is disposed between the stopper and each of the nip formation pad and the support.

13. The fixing device according to claim 12, wherein the heat-resistant resin is bonded to the stopper.

14. The fixing device according to claim 10, further comprising:

a side plate holding at least one of the nip formation pad and the support, wherein the stopper extends to the side plate and is held by the side plate.

15. The fixing device according to claim 14, wherein the stopper includes a flat spring portion, and wherein the stopper is held by the side plate with an elastic force generated in the flat spring portion.

16. The fixing device according to claim 15, wherein the flat spring portion includes a heat-resistant resin having a higher friction coefficient than a friction coefficient of the stopper relative to the nip formation pad and the support.

17. An image forming apparatus comprising:

an image forming device to form an image on a recording medium; and the fixing device according to claim 10 to fix the image on the recording medium.

* * * * *